United States Patent [19]

Nishiyama et al.

[11] Patent Number: 5,035,744

[45] Date of Patent: Jul. 30, 1991

[54] ELECTROLESS GOLD PLATING SOLUTION

[75] Inventors: Koji Nishiyama; Masayuki Yamazaki; Takeshi Tsukuda; Youtaro Arai, all of Saitama, Japan

[73] Assignee: Kojima Chemicals Co., Ltd., Tokyo, Japan

[21] Appl. No.: 550,305

[22] Filed: Jul. 9, 1990

[30] Foreign Application Priority Data

Jul. 12, 1989 [JP] Japan ..... 69-177984

[51] Int. Cl.[5] ..... C23C 18/44

[52] U.S. Cl. ..... 106/1.23; 106/1.13; 252/514; 427/304

[58] Field of Search ..... 106/1.13, 1.18, 1.26, 106/1.23; 252/512, 514; 427/304

[56] References Cited

FOREIGN PATENT DOCUMENTS 0225041 6/1987 European Pat. Off. ..... 106/1.13

3614090 4/1987 Fed. Rep. of Germany ..... 106/1.18

*Primary Examiner*—Mark L. Bell

*Assistant Examiner*—Anthony J. Green

*Attorney, Agent, or Firm*—Wegner, Cantor, Mueller & Player

[57] ABSTRACT

An electroless gold plating solution containing 0.1 to 10 ml/l of ethyleneamines and 0.1 to 10 g/l of hexamethylenetetramine as complexing agents in addition to the solution comprising water-soluble gold salts, pH controlling agents, catalysts, alkylamine boranes, alkali cyanides and ethylendiamine tetraacetic acid.

According to the present invention, thick coating of a gold plating film having high quality and gloss is possible and the plating time becomes very short.

8 Claims, No Drawings

ELECTROLESS GOLD PLATING SOLUTION

BACKGROUND OF THE INVENTION

1. Field of the Invention

The present invention relates to an electroless gold plating solution, and more particularly, relates to an electroless gold plating solution capable of providing a thick gold film having high quality and gloss within a very short time to an article to be plated.

2. Description of the Prior Art

The electroless gold plating solution which is conventionally used in the past is prepared by adding into potassium gold(I) cyanide as a source of gold, sodium boron hydride, and dimethylamine borane as reducing agents, alkali cyanide as a complexing agent, and moreover potassium hydroxide and sodium hydroxide as pH controlling agents, etc..

With said solution the thickness of the gold plated film to be deposited is 1.5 μm/hour, and thus, the thick cooling is possible. But, there are some practical problems in the aforementioned electroless solution in that the surface of the film becomes easily discolored to brown color, the stability thereof is inferior, the solution is easily decomposed and obtaining the supply thereof is difficult.

The inventors made various studies for eliminating the aforementioned faults residing in said prior electroless gold plating solution, and consequently reached this invention by finding that the plating speed becomes high and furthermore the thick coating becomes possible by using as complexing agents, ethyleneamines and hexamethylenetetramine in combination in addition to ethylenediaminetetraacetic acid.

SUMMARY OF THE INVENTION

It is an object of the present invention to provide an electroless gold plating solution wherein the disadvantages found in the prior are overcome.

It is another object of the present invention to provide such a solution wherein a thick coating of a gold plating film having high quality and gloss is possible.

It is furthermore another object of the present invention to provide such a solution wherein the plating time is very short.

According to the present invention, the above objects are accomplished by providing an electroless gold plating solution containing 0.1 to 10 ml/l of ethyleneamines and 0.1 to 10 g/l of hexamethylenetetramine as complexing agents in addition to the solution comprising water-soluble gold salts, pH controlling agents, catalysts, alkylamine boranes, alkali cyanides and ethylenediamine tetraacetic acid.

DETAILED DESCRIPTION

The present invention is illustrated in detail as follows.

The water-soluble gold salts used in the present invention are alkali metal salts of gold cyanides, and are exemplarily designated as potassium gold cyanide, sodium gold cyanide, etc..

As the pH controlling agents potassium hydroxide and sodium hydroxide are used, and with the alkali hydroxide, the pH of the plating solution is kept at a value higher than 12.

Moreover, in the present invention, lead salts, such as lead chloride, lead nitrate, lead acetate, etc., are added as the catalysts for maintaining the deposition speed of the solution.

Furthermore, as complexing agents in the present invention, ethyleneamines and hexamethylenetetramine are used in combination in addition to the prior art agents, such as alkali cyanide (patassium cyanide, sodium cyanide), ethylenediamineteraacetic acid, etc., and said ehtylenamines are exemplarily designated as tetraethylenepentamine, triethylenetetramine, etc..

In the present invention, the standard components of the electroless gold plating solution and the plating conditions are generally designated as follows.

| | |
|---|---|
| Potassium gold cyanide(as a gold) | 1-5 g/l |
| Ethyleneamines | 0.1-10 ml/l |
| Hexamethylenetetramine | 0.1-10 g/l |
| Ethylenediaminetetraacetic acid | 1-20 g/l |
| Alkali hydroxide | 5-100 g/l |
| Dimethylamine borane | 1-20 g/l |
| Pb ion | several ppm |
| Plating condition | |
| temperature of the solution 50-90° C. | |
| Air stirring | |
| pH higher than 12.0 | |

According to the aforementioned components of the non-electrolytic gold plating solution, the films having thickness of 6 to 30 μm/hrs can be obtained;

The electroless gold plating solution of the present invention is very excellent in the stability of the solution and 5 to 10 times higher in plating speed than the prior art electroless gold plating solution, since ethyleneamines and hexamethylenetetramine are used therein in combination as the complexing agent.

EXAMPLE

The present invention is exemplarily explained in the example as follows.

| | |
|---|---|
| Potassium gold cyanide | 5.84 g/l |
| Sodium hydoxide | 20 g/l |
| Ethylenediaminetetraacetic acid | 4 g/l |
| Potassium cyanide | 2 g/l |
| Tetraethylenepentamine | 1 ml/l |
| Hexamethylenetetramine | 1 g/l |
| Dimethylamine borane | 7.5 g/l |
| Lead acetate | 10 ppm |

With the electroless gold plating solution having the afore-mentioned components, the electroless gold plating was carried out on the pre-treated brass test plate with the following steps.

(Pre-treatment)

Surface abrasion→degreasing→washing with water→electrolytic degreasing→washing with water→washing with water→activation with palladium→washing with acids→washing with water→electroless nickel plating→washing with water→activation with sulfuric acid→washing with water→substitution with electroless gold plating→washing with water.

| | |
|---|---|
| The thickness of the electroless nickel plating | 2-3 μm |
| The thickness of the substituted gold plating | 0.03-0.05 μm |
| (Plating condition) | |
| Temperature of the solution | 75° C. |

pH value is kept to 13 or more, and air stirring is carried out.

The pre-treated brass test plate is submerged into the plating solution for 1 hour, washed with water and dryed.

The half-lustrons film of gold plating was obtained with the thickness of 0.6 μm. This shows that the deposition speed is 4 times higher as the prior art electroless gold plating solution. Moreover, the continuous supply of the solution becomes possible with about 1.5 turn, and the stability of the solution is highly improved.

Comparative Example 1

| | |
|---|---|
| potassium gold cyanide | 1.45 g/l |
| potassium cyanide | 6.5 g/l |
| potassium hydroxide | 11.2 g/l |
| potassium boron hydride | 10.8 g/l |

Into the electroless gold plating solution having the aforementioned components, the brass test plate same as said Example was submerged at a solution temperature of 75° C. for 1 hour. As a result, the thickness of the obtained plating film was 1.26 μm.

Comparative Example 2

| | |
|---|---|
| potassium gold cyanide | 5.80 g/l |
| potassium cyanide | 13.0 g/l |
| potassium hydroxide | 11.2 g/l |
| potassium boron hydride | 21.6 g/l |

Into the electroless gold plating solution having said components, the brass test plate same as said Example was submerged at a solution temperature of 75° C. for 1 hour. As a result, the thickness of the obtained plating film was 0.60 μm.

According to the electroless gold plating solution, the inferiority such as solder resist etc. can be eliminated since the thick coating of the gold film is carried out a very short time, and thus the present invention is effective in increasing the efficiency of the gold plating process and decreasing the cost.

What is claimed is:

1. In an electroless gold plating solution comprising water-soluble gold salts, pH controlling agents, catalysts, alkylamine boranes, alkali cyanides and ethylenediamine tetraacetic acid, an improvement wherein: 0.1 to 10 ml/l of ethyleneamines and 0.1 to 10 g/l of hexamethylenetetramine are contained as complexing agents in said solution.

2. The electroless gold plating solution according to claim 1, wherein said ethyleneamines are selected from the group consisting of tetraethylenepentamine and triethylenetetramine.

3. The electroless gold plating solution according to claim 1, wherein said water-soluble gold salts are alkali metal salts of gold cyanides.

4. The electroless gold plating solution according to claim 3, wherein said alkali metal salts of gold cyanides are selected from the group consisting of potassium gold cyanide and sodium gold cyanide.

5. The electroless gold plating solution according to claim 1, wherein said pH controlling agents are selected form the group consisting of sodium hydroxide and potassium hydroxide.

6. The electroless gold plating solution according to claim 1, wherein said catalysts are lead salts.

7. The electroless gold plating solution according to claim 1, wherein said alkylamine borane is dimethylamine borane.

8. The electroless gold plating solution according to claim 1, wherein said alkali cyanides are selected form the group consisting of potassium cyanide and sodium cyanide.

* * * * *